US008444823B2

(12) United States Patent
Wyczalkowski et al.

(10) Patent No.: US 8,444,823 B2
(45) Date of Patent: May 21, 2013

(54) METHOD AND APPARATUS FOR PAPER STOCK MIXING

(75) Inventors: Wojciech Roman Wyczalkowski, Harrisburg, PA (US); Todd Michael Hutchinson, Palmyra, PA (US); Marc Robards Moseley, Roswell, GA (US)

(73) Assignee: Philadelphia Mixing Solutions, Ltd., Palmyra, PA (US)

( * ) Notice: Subject to any disclaimer, the term of this patent is extended or adjusted under 35 U.S.C. 154(b) by 555 days.

(21) Appl. No.: 12/056,507

(22) Filed: Mar. 27, 2008

(65) Prior Publication Data

US 2009/0242155 A1 Oct. 1, 2009

(51) Int. Cl.
*D21F 7/06* (2006.01)

(52) U.S. Cl.
USPC ..... 162/263; 162/198; 162/258; 366/264; 366/270; 366/307

(58) Field of Classification Search
USPC ..... 366/264, 270, 307; 162/198, 258, 162/264
See application file for complete search history.

(56) References Cited

U.S. PATENT DOCUMENTS

| | | | | |
|---|---|---|---|---|
| 4,415,408 A | * | 11/1983 | Greey | 162/198 |
| 4,838,704 A | | 6/1989 | Carver | |
| 5,762,417 A | * | 6/1998 | Essen et al. | 366/264 |
| 6,086,716 A | | 7/2000 | Watson et al. | |
| 6,200,421 B1 | | 3/2001 | Meinander | |
| 6,680,354 B2 | | 1/2004 | Knapp et al. | |
| 2006/0176771 A1 | * | 8/2006 | Adams | 366/270 |

OTHER PUBLICATIONS

Nienow A.W., Elson T.P., Aspects of Mixing in Rheologically Complex Fluids. Chem Eng Res Des, vol. 66, 1988, pp. 5-15.
Amanullah A., Hjorth S.A., Nienow A.W., A New Mathematical Model to Predict Cavern Diameters in Highly Shear Thinning, Power Law Liquids Using Axial Flow Impellers, Chemical Engineering Science, vol. 53, No. 3, pp. 455-469, 1998.
H.A. Barnes, J.F. Hutton, K. Walters, An Introduction to Rheology, Chapters 7 and 8, pp. 115-157, Elsevier, 1989.
International Patent Application No. PCT/US09/38569: International Search Report dated Jan. 12, 2010, 2 pages.

* cited by examiner

*Primary Examiner* — Jacob Thomas Minskey
(74) *Attorney, Agent, or Firm* — Woodcock Washburn LLP

(57) ABSTRACT

A method of mixing paper stock, having improved outlet consistency, includes: (a) feeding liquid and feeding paper pulp into a vessel to form a mixture; (b) providing at least one counterflow impeller that is submerged in the mixture, the counterflow impeller being capable of simultaneously inducing both upward flow and downward flow; (c) rotating the counterflow impeller such that downward flow from the impeller is partially recirculated by upward flow from the impeller to form a mixing zone; (d) sensing a parameter of the mixture discharged from the vessel; and (e) controlling the feed rate of the liquid and the feed rate of the paper pulp in the feeding step (a) based on the sensing step (d). An apparatus for mixing of paper stock, having improved outlet consistency, includes a vessel for containing liquid and paper pulp, at least one counterflow impeller, and a feedback system for controlling outlet consistency.

25 Claims, 4 Drawing Sheets

METHOD AND APPARATUS FOR PAPER STOCK MIXING

FIELD OF THE INVENTION

The present invention relates to a method and apparatus for mixing, and more particularly to a method and apparatus for mixing liquid and paper pulp, especially for improving outlet consistency of and removing gas from paper stock prior to feeding the paper pulp mixture to a paper making machine.

BACKGROUND OF THE INVENTION

In the process of making paper stock, ingredients such as paper pulp and water are fed at a controlled rate into a stock mixing tank, often called a "machine chest." After initial mixing in the unrefined stock chest, the paper pulp and water mixture is fed into a second vessel called a "primary machine chest." A higher consistency of paper pulp output from the primary machine chest (by weight percent) tends to lead to a more efficient papermaking process (e.g., less paper stock required for a given minimum paper thickness).

Consistency of paper pulp weight percentage in paper stock has traditionally been achieved by using large mixing vessels and adding water injection control loops and water bypass loops into the paper pulp and water mixing system. Also, in many typical paper pulp mixing systems, a single impeller is located at the vessel bottom, near the outlet, such that there is only a single mixing zone. This configuration may be prone to channeling or insufficient mixing.

Some paper pulp mixing systems use multiple impellers. However, the inventors theorized that when impellers are spaced too close to each other or are operated at a high speed, they may create a single large mixing zone. This results in a "short circuiting" tank dynamic behavior, where fresh material added to the top of the stock chest is quickly pulled downward by the impellers towards the outlet, without much mixing. As in channeling, the short circuiting problem has the disadvantages of a limited mixing zone (some of the paper pulp towards the vessel sidewalls is not being mixed, producing "stagnant zones") and inconsistency of paper pulp weight percentage at the outlet (because the newly-added paper pulp is forced towards the outlet before sufficient mixing can be achieved). This system dynamic can only have limited improvement by using a control loop feedback system, because there is too short of a time delay between the inlet disturbance and the outlet signal.

The inventors theorize that in order to prevent short circuiting behavior, some paper pulp mixing systems use multiple impellers that are spaced too far apart from each other or are operated at too low of a speed, which may create separate mixing and dynamic behavior that forms "caverns" and stagnant zones. The caverns are the separate mixing zones that mix a relatively small portion of the paper pulp in the stock chest. This leads to inadequate mixing of the paper pulp and water, and it results in poor paper pulp weight percentage consistency at the outlet.

Paper pulp often contains more than 10% air (by volume), which is bound in the fiber network, primarily in the form of small bubbles. Excessive entrapped air in the paper pulp is undesirable in the paper-making process.

This description of the background summarizes some observations of the prior art. However, the disclosure identified as the theorizing of the inventors is not intended to be an admission that the observations are part of the prior art. Further, the present invention is not limited to possessing all of these characteristics that constitute an advance over the prior art nor is the present invention limited to possessing all the solutions to the problems of the prior art.

SUMMARY OF THE INVENTION

A method and apparatus for mixing liquid and paper pulp includes one or more of the following attributes, diminished: paper stock consistency fluctuation at the outlet of the unrefined stock chest or primary machine chest; channeling; short circuiting; creation of caverns and stagnant zones; and entrapment of excess gas.

A method of mixing of paper stock, having improved outlet consistency, includes: (a) feeding liquid and feeding paper pulp into a vessel to form a mixture; (b) providing at least one counterflow impeller that is submerged in the mixture, the counterflow impeller being capable of simultaneously inducing both upward flow and downward flow; (c) rotating the counterflow impeller such that downward flow from the impeller is partially recirculated by upward flow from the impeller to form a mixing zone; (d) sensing a parameter of the mixture that is discharged from the vessel; and (e) controlling the feed rate of the liquid and the feed rate of the paper pulp in the feeding step (a) based on the sensing step (d).

An apparatus for mixing of paper stock, having improved outlet consistency, includes a vessel for containing liquid and paper pulp, at least one counterflow impeller, and a feedback system for controlling outlet consistency. The counterflow impeller is adapted for submerging below the liquid and paper pulp surface and adapted for simultaneously inducing both upward flow and downward flow. The feedback system for controlling outlet consistency includes a sensor capable of determining a parameter of the mixture that is discharged from the vessel and a controller capable of adjusting the feed rate of the liquid and the feed rate of the paper pulp that enters the vessel.

The method and apparatus of mixing paper stock, having improved outlet consistency, may also include providing at least one additional impeller, spaced apart from the counterflow impeller such that each impeller can produce a substantially separate mixing zone. The parameter that is sensed in the method and apparatus of mixing paper stock, having improved outlet consistency, may also be percent paper pulp by weight or a proxy for percent paper pulp by weight. Proxies for the percent paper pulp by weight parameter will be understood by persons familiar with paper pulp technology and its instrumentation.

The paper stock produced at the outlet in the method and apparatus of mixing paper stock, having improved outlet consistency, may also contain up to approximately seven (7) percent paper pulp by weight.

At least one of the counterflow impellers that are provided in the method and apparatus of mixing paper stock, having improved outlet consistency, may also have a diameter that is between approximately seventy (70) percent and approximately ninety (90) percent of the vessel diameter. One of the counterflow impellers may also be adapted to be adjacent to the mixture surface. Each of the counterflow impellers may also have a tip speed that does not exceed approximately three (3) meters per second. The vessel may also include at least one water injection port. The vessel preferably is a primary machine chest or an unrefined stock chest having a vertical orientation, a top end, and a bottom end, and the paper pulp enters the vessel near the top end and exits near the bottom end. At least one of the counterflow impellers preferably has an axis of rotation that is substantially perpendicular to the vertical orientation of the vessel.

These and various other advantages and features are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

DETAILED DESCRIPTION OF ILLUSTRATIVE EMBODIMENTS

Figure 1:
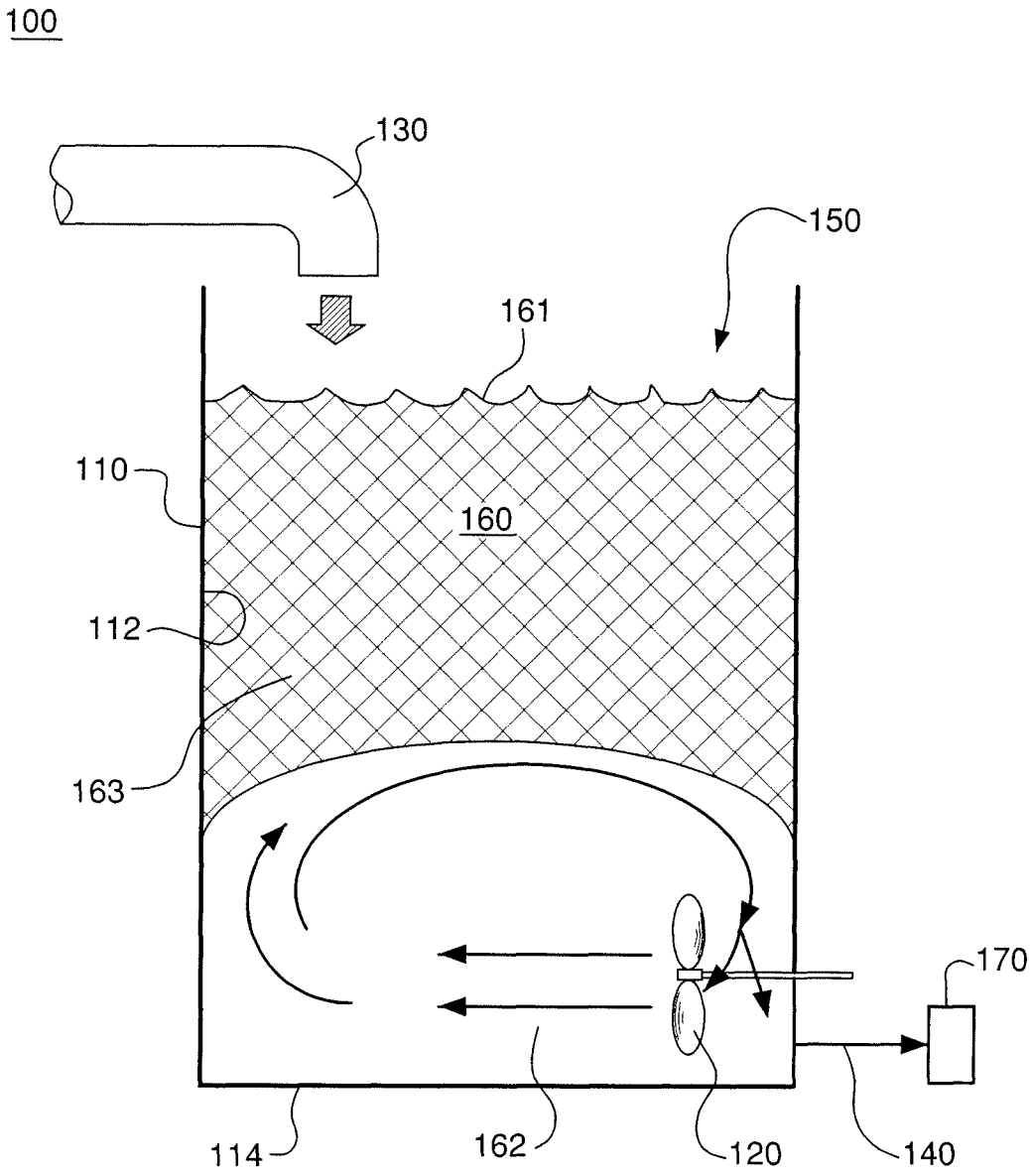
FIG. 1 (Prior Art)
FIG. 1 is a diagrammatic view of a prior art conventional paper stock mixing system.

Referring to FIG. 1, a prior art paper stock mixing system 100 includes a vessel 110, an impeller 120, a paper pulp inlet 130, a paper pulp outlet 140, and a water inlet control system 150. Vessel 110 includes a vessel sidewall 112 and a vessel bottom 114. Within vessel 110, a paper pulp mixture 160, as shown in FIG. 1, includes an upper surface 161, an active mixing zone 162, and often includes a stagnant zone 163. After mixing inside vessel 110, paper pulp mixture 160 is fed through paper pulp outlet 140 to paper machine 170 for further processing.

Typically, because of the specific rheology of paper pulp at consistency levels up to seven percent (7%) paper pulp by weight, the active mixing zone 162 occupies only part of vessel 110, as illustrated in FIG. 1. The remainder of paper pulp mixture 160 may be located in a stagnant zone 163. Stagnant zone 163 is not necessarily completely stagnant, but it is relatively stagnant in relation to the higher velocity vectors found in active mixing zone 162.

Figure 2A:
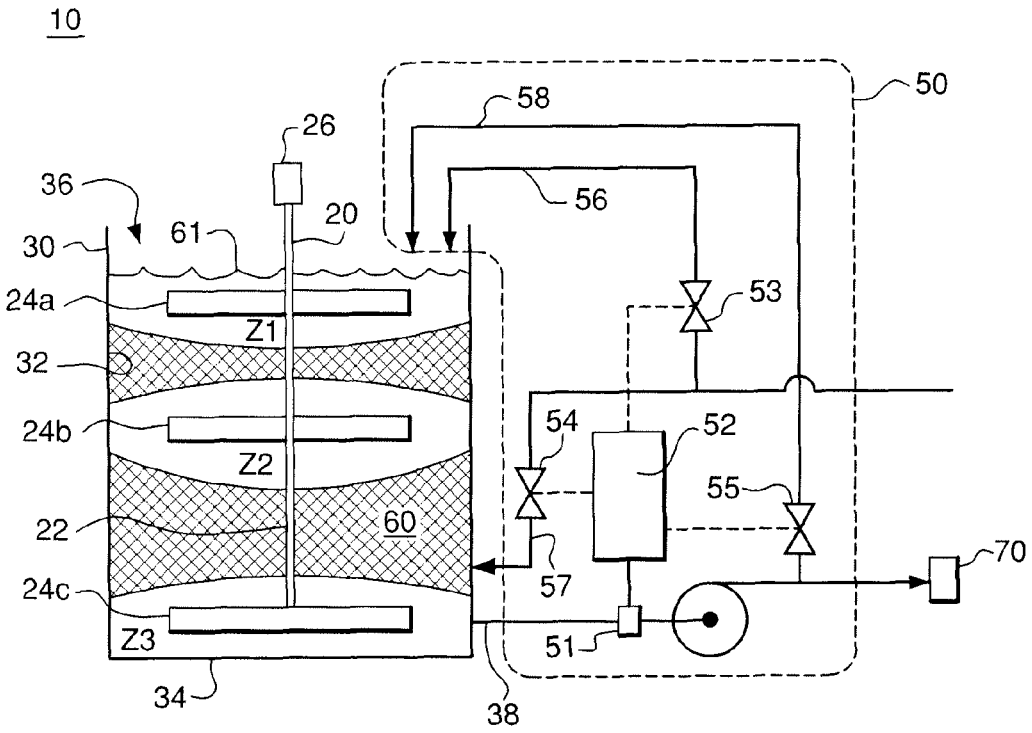
FIG. 2A is a diagrammatic view of a paper stock mixing system illustrating an embodiment of the present invention.

Referring to FIG. 2A, a paper stock mixing system 10 includes a counterflow impeller assembly 20, a mechanical drive 26, a vessel 30, a paper pulp inlet 36, a paper pulp outlet 38, a water inlet control system 50, and paper pulp mixture 60. A paper machine 70 is located downstream of mixing system 10. Counterflow impeller assembly 20 includes a shaft 22, a top counterflow impeller 24*a*, a middle counterflow impeller 24*b*, and (optionally) a lower counterflow impeller 24*c*. Vessel 30 includes a vessel sidewall 32 and a vessel bottom 34. Water inlet control system 50 includes an outlet water sensor 51, an inlet water controller 52, an upper water valve 53, a lower water valve 54, a pulp drainage valve 55, an upper water inlet 56, a lower water inlet 57, and a pulp drainage inlet 58. Paper pulp mixture 60 defines an upper surface 61, and it includes active mixing zones Z1, Z2, and Z3. Paper pulp mixture 60 enters vessel 30 from the top, via paper pulp inlet 36. Inside vessel 30, paper pulp mixture 60 is diluted, by mixing it with water from water inlets 56, 57, and 58.

In an exemplary embodiment, a paper stock mixing system 10 allows mixing of paper pulp mixture 60 up to approximately seven percent (7%) paper pulp by weight, with the remainder of the mixture comprising water.

Figure 2B:
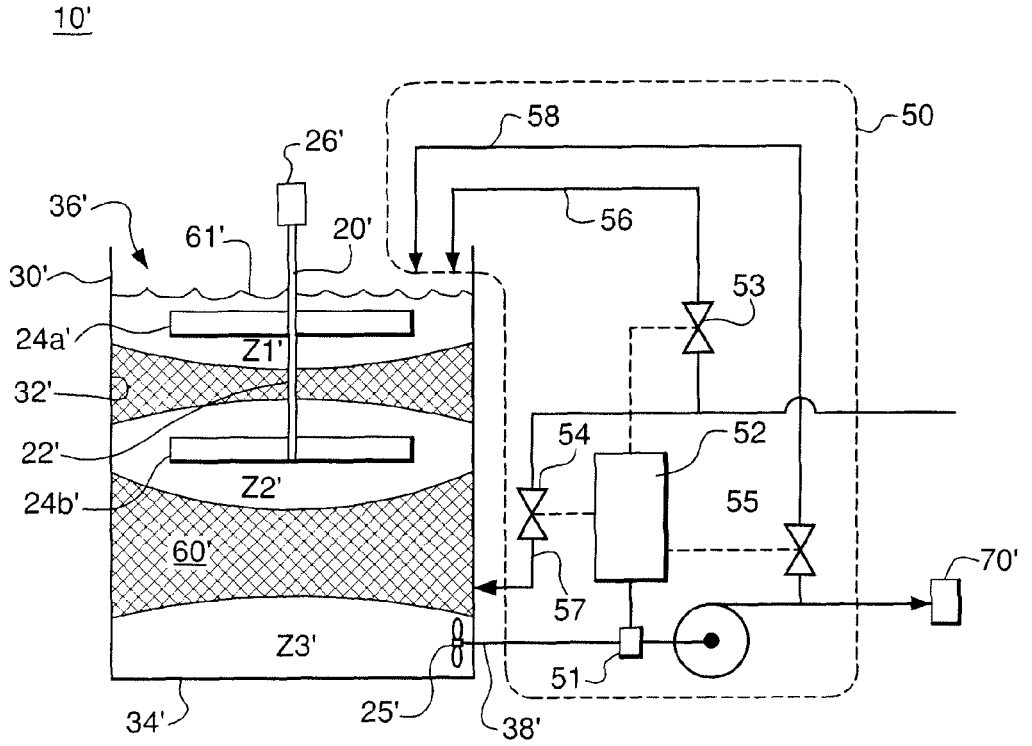
FIG. 2B is a diagrammatic view of a paper stock mixing system illustrating another embodiment of the present invention.

Counterflow impellers 24*a*, 24*b*, and 24*c* are used to mix the paper pulp mixture 60 in vessel 30. System 10 preferably includes two or three counterflow impellers 24, as shown in FIGS. 2A and 2B, respectively, and the invention contemplates other numbers of impellers. A single counterflow impeller 24 may also be used. The counterflow impellers 24 preferably are submerged, i.e., located entirely beneath the upper surface 61, in mixture 60. Newly added paper stock mixture 60 slowly moves through counterflow impellers 24*a*, 24*b*, and 24*c* and the corresponding active mixing zones Z1, Z2, and Z3 and is pumped out of vessel 30 after dilution via paper pulp outlet 38.

Using multiple mixing impellers 24, in embodiments having multiple impellers 24, helps create separate mixing zones Z1, Z2, and Z3 in the portions of the vessel surrounding each impeller, which helps to prevent the problem of channeling. In some examples of channeling, there is only a single active mixing zone at the vessel bottom, so newly added paper pulp is forced down to the active mixing zone in a "channel" through the "stagnant zone" that occupies the upper portion of the vessel.

To maintain separate active mixing zones Z1, Z2, and Z3, the impellers 24 preferably are spaced far enough apart and be operated at a slow enough rotational velocity such that mixing is complete within each mixing zone (i.e., the paper pulp mixture that enters an active mixing zone reaches approximately the same percentage of paper pulp by weight as the paper pulp mixture already in the particular zone), and such that the mixing zones don't combine together into a single mixing zone. In a preferred embodiment, in order to create separate mixing zones between the impellers, the impellers are spaced at least 33% of the impeller diameter apart from each other. The optimal spacing between the impellers depends on the dimensions of vessel 30, impeller rotational speed, parameters of mixture, and the like, as will be understood by persons familiar with mixing technology in view of the present disclosures.

To prevent active mixing zones from being too far apart, the impellers 24 preferably are spaced close enough together and operated at a high enough rotational speed such that newly added paper pulp spends some time being mixed in each active mixing zone Z1, Z2, and Z3, without spending substantial time in a stagnant zone between mixing zones.

Using multiple impellers 24 of a counterflow design, such as is shown in the Figures, at a predetermined distance from each other helps in many circumstances to achieve a balance between two undesirable conditions: (1) short circuiting behavior, where active mixing zones are so close together that they effectively combine into a single mixing zone, so newly added paper pulp quickly reaches the vessel bottom and exits via the paper pulp outlet before complete mixing can be achieved, and (2) caverns with stagnant zones, where active mixing zones are so far apart (creating "caverns") that a substantial portion of the tank is not effectively mixed ("stagnant zones"). Impellers 24 preferably are configured such that the inner part pumps fluid in the opposite direction from the outer part. The spacing between impellers 24 depends on tank dimensions, impeller speed and configuration, desired paper pulp weight percentage in mixture 60, and the like, as will be understood by persons familiar with mixing technology.

Figure 3A:
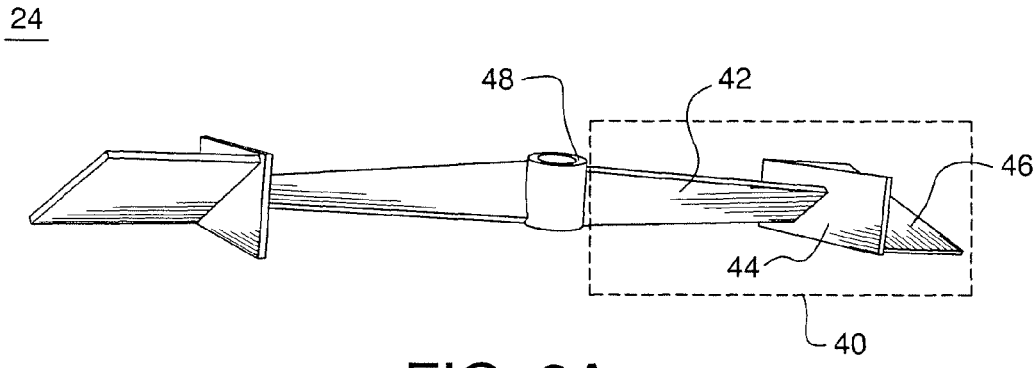
FIG. 3A is a diagrammatic view of a counterflow impeller employed in the paper stock mixing system.
Figure 3B:
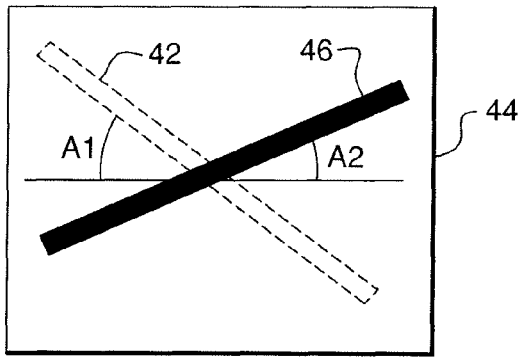
FIG. 3B is a diagrammatic view of the pitch angle orientation of the counterflow impeller blade assembly of FIG. 3A.
Figure 3C:
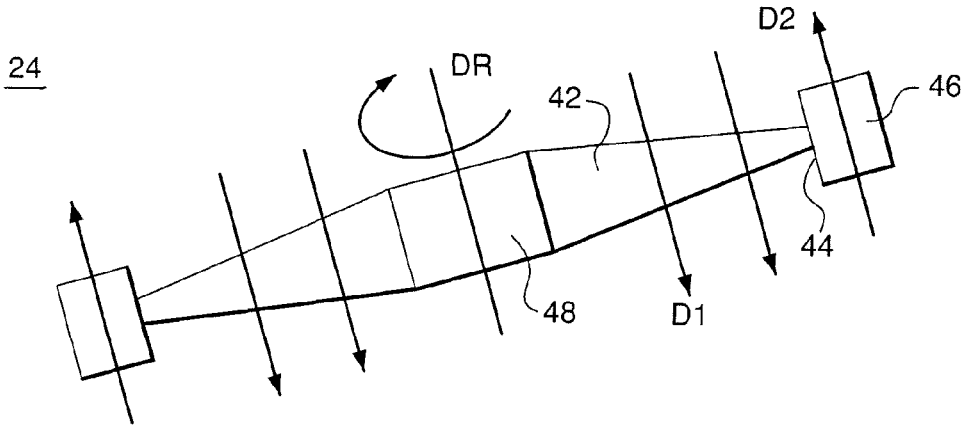
FIG. 3C is a diagrammatic view of the flow pattern created by the counterflow impeller of FIG. 3A.

Using multiple counterflow impellers 24 allows, in many circumstances, each of the active mixing zones Z1, Z2, and Z3 to slightly overlap at the outer boundary. For example, the lower boundary of mixing zone Z1 slightly overlaps the upper boundary of mixing zone Z2. Each counterflow impeller 24, as shown in FIGS. 3A, 3B, and 3C, preferably simultaneously moves paper pulp mixture 60 in multiple directions, when rotated about the impeller's rotational axis. When counterflow impeller 24*a* is rotated clockwise, paper pulp mixture 60 is forced down through the inner part of the impeller (closest to the axis of rotation), while at the same time, another portion of the paper pulp mixture 60 within the same mixing zone is forced up through the outer part of the impeller (furthest from the axis of rotation). The combination of these two simultaneous flows caused by the rotation of each counterflow impeller circulates paper pulp mixture 60 around, within the active mixing zone. After spending some time in zone Z1, the lowest portion of paper pulp mixture 60 in zone Z1 is continuously forced down into zone Z2 by the paper pulp flow through vessel 30, where this portion is circulated around zone Z2. After spending some time in zone Z2, the portion of mixture 60 in zone Z2 is forced down into zone Z3 by continuous paper pulp flow through vessel 30, where it is circulated further. After spending some time in zone Z3, the portion of mixture 60 closest to outlet 38 is removed from vessel 30 for further processing in paper machine 70.

Using multiple counterflow impellers 24 provides multiple areas of "zonal mixing" to maximize the time paper pulp mixture 60 spends being actively mixed, while minimizing the short circuiting potential from new stock flow. Also, using multiple counterflow impellers 24 allows for complete mixing at a slower impeller rotation speed than using multiple conventional impellers, resulting in an energy cost savings, minimization of potential fiber shear damage, and an increase in the mean time between failure of the mixing system 10 components. Conventional impeller systems require significantly greater power and produce less flow than counterflow impeller systems. By pumping simultaneously upwards and downwards, counterflow impellers can mix paper pulp stock more evenly throughout all of vessel 30, with minimal stagnant zones.

Using multiple counterflow impellers 24 enhances the capability of paper stock mixing system 10 to achieve a higher pumping rate (faster production of completely mixed paper stock out of outlet 38) than using conventional impellers because the system can efficiently operate at much higher impeller-to-tank diameter ratios than a system using conventional impellers. The counterflow impellers may have any diameter relative to the diameter of vessel 30, depending on the desired process parameters. In a preferred embodiment, counterflow impellers 24*a*, 24*b*, and 24*c* have a diameter that ranges from seventy (70) to ninety (90) percent of the diameter of vessel 30. Paper stock at up to 7% consistency typically has a very high yield stress and is difficult to mix. Using multiple counterflow impellers with a diameter between 70% and 90% of the diameter of vessel 30 helps circulate the portions of paper pulp mixture 60 that are close to vessel sidewall 32, thereby minimizing stagnant zones at the vessel sidewall.

Water inlet control system 50, which preferably is conventional, uses the signals from outlet water sensor 51 to adjust the water flow volume and rate of entry into vessel 30. Control system 50 keeps consistency fluctuations (percentage paper pulp by weight) at target values by adjusting the flow volume and rate of water that enters vessel 30. Within paper pulp outlet 38, outlet water sensor 51 measures paper pulp mixture 60 flow speed and consistency (percentage paper pulp by weight). The parameters sensed by outlet water sensor 51 of the flow of mixture 60 that is discharged from vessel 30 may include, but is not limited to, flow speed, percentage paper pulp by weight, moisture content, viscosity, or any other parameter that is a proxy for the listed parameters. Other parameters may be sensed by outlet sensor 51, the control of which would help improve the consistency of paper pulp mixture 60 that is discharged from vessel 30.

The water inlet control is accomplished by sending the signals from outlet water sensor 51 to inlet water controller 52, which controls the rate and volume of water flow through upper water valve 53, lower water valve 54, and pulp drainage valve 55. These three valves 53, 54, and 55 control the rate and volume of water flow into vessel 30 via upper water inlet 56, lower water inlet 57, and pulp drainage inlet 58, respectively.

Using multiple counterflow impellers 24 increases the time constant of water inlet control system 50 (i.e., the newly added paper pulp mixture 60 entering through paper pulp inlet 36 spends a longer time being mixed before it reaches paper pulp outlet 38). This longer time constant decreases the fluctuation of paper pulp consistency (percentage paper pulp by weight) at paper pulp outlet 38 that results from introduction of new paper pulp with a different percentage paper pulp by weight than the paper pulp mixture 60 already in vessel 30.

Mechanical drive 26 may be any mechanical drive known in the pertinent art that may be adapted to rotate shaft 22 and blade assemblies 40 to the desired speed, such as a gear box, a belt drive, and the like. Mechanical drive 26 is coupled to the upper end of shaft 22. In a preferred embodiment, a reinforced gear drive is used, which is specifically designed to handle the high level of torque required for paper pulp mixing applications. The reinforced gear drive includes a heavy-duty stress relieved housing with additional gusseting to resist "racking."

Another embodiment of the invention is shown in FIG. 2B, in which reference numerals for some structure or components are reused but appended with a prime (') designation to indicate their usage is second embodiment system 10', where one or more new counterflow impellers 24' may be retrofitted to a mixing system 10' that includes an already-existing lower conventional impeller 25', typically positioned near paper pulp outlet 38'. This system orientation also allows the creation of multiple paper pulp active mixing zones Z1', Z2', and Z3' within vessel 30', with the benefit of increased paper pulp mixture 60' consistency at paper pulp outlet 38'. In a preferred embodiment, counterflow impeller assembly 20' includes two counterflow impellers 24*a'* and 24*b'*, which create active mixing zones Z1' and Z2'. Zone Z3' is created by the already-existing lower conventional impeller 25'. Mixing system 10' operates in a similar manner as the mixing system 10 embodiment shown in FIG. 2A, except that the shape and velocity vectors in zone Z3' will be different, due to the different position, shape, and rotational velocity of the lower impeller.

In FIGS. 3A, 3B, 3C, and 4, the reference numerals for some structure or components of paper stock mixing system 10 and paper stock mixing system 10' are shown without a prime (') designation. However, it is to be understood that the related description for FIGS. 3A, 3B, 3C, and 4 refer to structure or components of both the paper stock mixing system 10 and paper stock mixing system 10' embodiments.

Referring to FIG. 3A, a counterflow impeller 24 (called 24*a*, 24*b*, and 24*c* in FIG. 2A and called 24*a'* and 24*b'* in FIG. 2B) includes plural counterflow blade assemblies 40 and a hub 48. Each blade assembly 40 includes an inner blade 42, a flow divider 44, and an outer blade 46. Counterflow impeller 24 may contain any number of impeller blade assemblies 40, but there are preferably two blade assemblies, as can be seen in FIG. 3A. Blade assemblies 40 may be of any material, including stainless steel or any other material known to those in the pertinent art. The use of the words "blade assembly" to label the combination of the inner blade 42, flow divider 44, and outer blade 46 is intended to include single and multiple-piece blade assemblies. A blade assembly 40 may be made of a single casting, or it may contain individual components that are welded or bolted together.

Preferably, inner blade 42 has a length of approximately seventy (70) percent of the radius of counterflow impeller 24. The distal end of inner blade 42 is connected to vertical flow divider 44. The proximal end of outer blade 46 is connected to vertical flow divider 44, on the opposite side from inner blade 42.

Hub 48 attaches each counterflow impeller 24 to the shaft 22 (shown in FIG. 2A as 22 and shown in FIG. 2B as 22'). In one exemplary embodiment, the torque transmitted by mechanical drive 26 to shaft 22 is transmitted from the shaft to hub 48. Hub 48 may be welded to shaft 22, or it may incorporate a keyway or set screw to prevent rotation of hub 48 relative to shaft 22. In another exemplary embodiment, hub 48 incorporates welded or casted ears for attachment of blade assemblies 40 to hub 48. In other embodiments, blade assemblies 40 are welded or bolted to hub 48. The lower end of shaft 22 may protrude below blade assemblies 40, reaching a lower depth in mixture 60 than the blades.

Referring to FIG. 3B, inner blade 42 and outer blade 46 may be pitched (rotated) at any angle to a plane that is perpendicular to the rotational axis of counterflow impeller 24. These pitch angles A1 and A2 allow the counterflow impeller to simultaneously move paper pulp mixture 60 in multiple directions. In one exemplary embodiment, inner blade 42 is pitched at approximately a forty-five (45) degree angle A1 from a plane that is perpendicular to the rotational axis of impeller 24, and outer blade 46 is pitched at approximately a thirty-two (32) degree angle A2 from a plane that is perpendicular to the rotational axis of impeller 24, in the opposite rotational direction to inner blade 42. In this embodiment, a Philadelphia Mixing Solutions Counterflow Impeller, which is diagrammatically shown in FIG. 3A, is used. Inner blade 42 and outer blade 46 may be pitched at angles A1 and A2 from approximately fifteen (15) to approximately seventy-five (75) degrees.

The present invention contemplates any counterflow impeller 24, any number of blade assemblies 40, and blade assemblies 40 of any length and configuration. The length of impeller blade assemblies 40, the length of inner blade 42 and outer blade 46, and the pitch angles A1 and A2 shown in FIGS. 3A and 3B may be scaled up or down, depending on the dimensions of vessel 30, the desired percentage of paper pulp by weight in mixture 60, and other process and dimension parameters.

FIG. 3C illustrates the ability of counterflow impeller 24 to simultaneously move paper pulp mixture 60 in multiple directions, when rotated about the rotational axis of impeller 24. As can be seen in FIG. 2B, when counterflow impeller 24 is rotated in a clockwise direction DR (as viewed from above), the portion of paper pulp mixture 60 that is towards the inside of the vertical flow divider 44 is generally pushed downward in direction D1 by inner blade portions 42. At the same time, portions of paper pulp mixture 60 near the outside of the vertical flow divider 44 are generally pushed upward in direction D2 by outer blade portions 46. This rotation of counterflow impeller 24 creates an active mixing zone Z (shown as Z1, Z2, and Z3 in FIG. 2A and shown as Z1', Z2', and Z3' in FIG. 2B), in which portions of paper pulp mixture 60 are circulated downward by inner blade portions 42, upward by outer blade portions 46, and then downward again by inner blade portions 42. This circulation motion provides effective mixing within active mixing zone Z when counterflow impeller 24 is rotated about its rotational axis.

Figure 4:
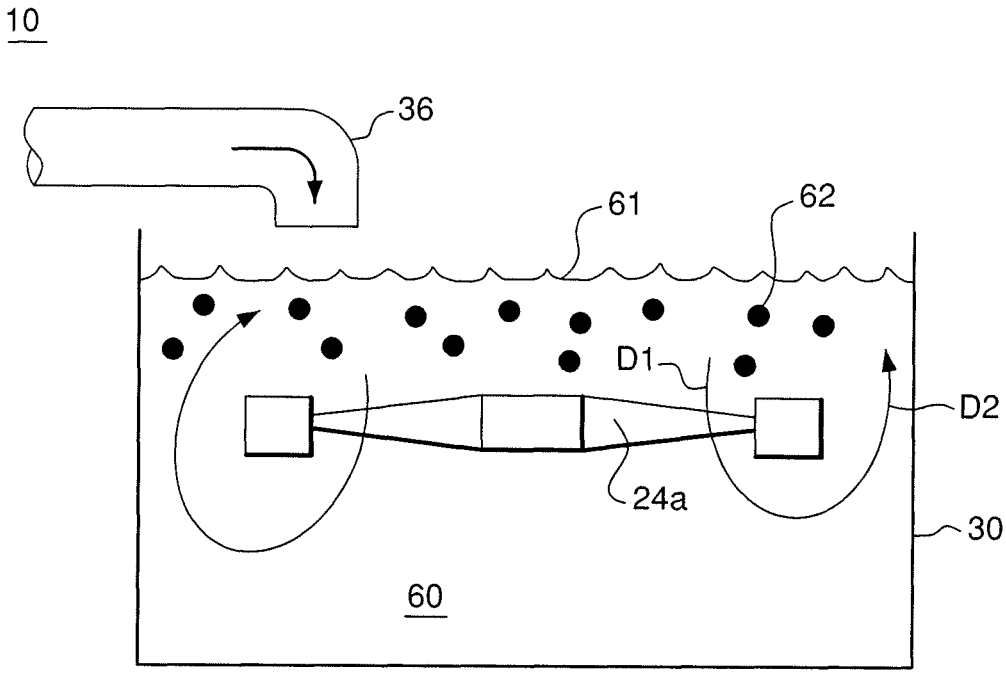
FIG. 4 is a diagrammatic view of a paper stock mixing system, illustrating the degassing function of the present invention.

Paper pulp that enters the paper stock mixing chest also tends to be degassified, as can be best seen in FIG. 4. Referring to FIG. 4, in a preferred embodiment, paper stock mixing system 10 contains an upper counterflow impeller 24*a* that operates in close proximity to the upper paper pulp surface 61 of paper pulp mixture 60. In order to enhance degassing of the paper pulp mixture 60 (defined below), the distance between the uppermost impeller 24*a* and the upper paper pulp surface 61 preferably is not greater than twenty percent (20%) of the diameter of impeller 24*a*. However, in other embodiments, this impeller positioning limit is optional, because the system may be effectively used for paper pulp mixing without maximizing the degassing functionality. The circulation of paper pulp mixture 60 in active mixing zone Z1 (that surrounds impeller 24*a* and may extend to the upper paper pulp surface 61) causes freshly added mixture 60 to be "tumbled" on surface 61, and this process helps to release gas bubbles 62 that are typically attached to the freshly added paper pulp fiber. This process is called degassing. In a preferred embodiment, in order to maximize degassing of paper pulp mixture 60 that freshly enters vessel 30 via inlet 36, the velocity of the outer tip of upper counterflow impeller 24*a* does not exceed 600 feet per minute (3 m/s).

In a paper stock mixing system that uses a conventional axial impeller, there may be an opposite effect of gas entrapment, where additional gas is incorporated into mixture 60. In a conventional system, the axial impeller may generate a vortex that incorporates gas from above surface 61 into mixture 60 after freshly added material enters via inlet 36.

Figure 5:
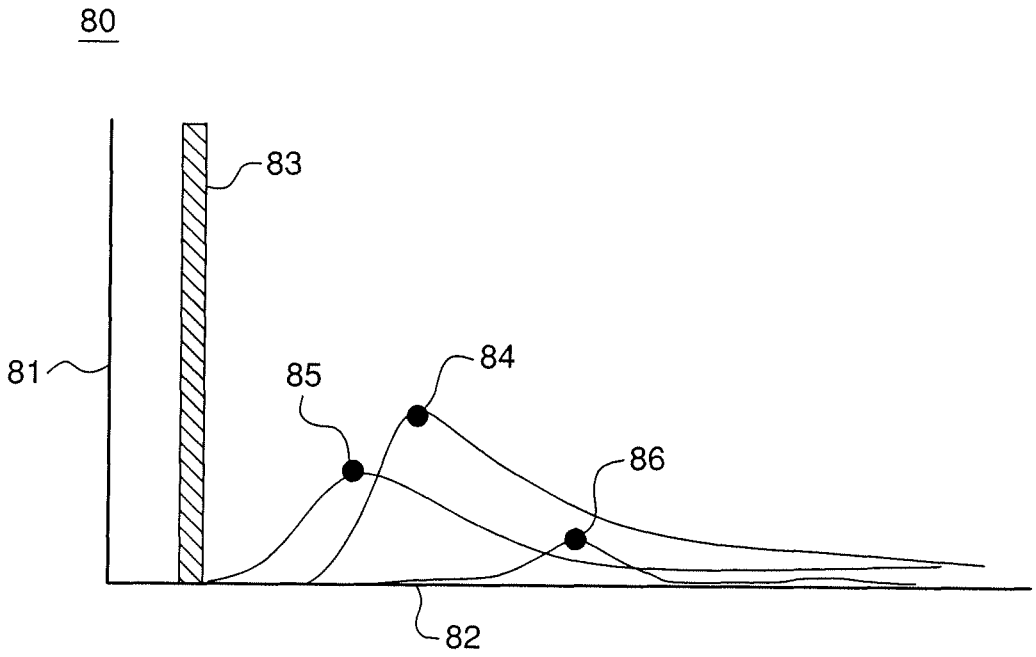
FIG. 5 is a qualitative comparison of the outlet response to a paper pulp weight percentage disturbance at the inlet for a paper stock mixing system, such as the systems shown in FIGS. 2A and 2B, compared to paper stock mixing systems with channeling and short circuiting behavior.

FIG. 5 is a qualitative comparison of the outlet response to a paper pulp weight percentage disturbance at the inlet for a paper stock mixing system, compared to paper stock mixing systems with channeling and short circuiting behavior. Referring to FIG. 5, a outlet behavior comparison graph 80 is shown, which displays paper pulp percentage by weight 81, along the vertical axis, as a function of time 82, along the horizontal axis. Graph 80 compares the outlet response of three systems to an inlet step function paper pulp disturbance 83: (1) a channeling system 84, (2) a short circuiting system 85, and (3) a counterflow impeller system 86.

Channeling system 84 is a system, for example, where a single impeller is located at the vessel bottom, near the outlet, and there is only a single mixing zone. This results in a "channeling" tank dynamic behavior, where the new paper pulp added to the top of the stock chest is pulled downward towards the outlet, through the old paper pulp already in the chest, creating a narrow "channel." In graph 80, channeling system 84 quickly (low time constant) transmits a high portion of the magnitude of the inlet step function disturbance 83 to the outlet. This behavior means that when new paper pulp is added to channeling system 84 that has a different paper pulp percentage by weight than the paper pulp mixture already in the vessel, this disturbance quickly affects the paper pulp percentage at the outlet. This low degree of dampening of an input disturbance is not ideal for the output of paper pulp mixing system.

Short circuiting system 85 is a system, for example, where multiple impellers are spaced too close to each other or are operated at a high speed, so a single large mixing zone is created. This results in a "short circuiting" tank dynamic behavior, where fresh material added to the top of the stock chest is quickly pulled downward by the impellers towards the outlet, without much mixing. In graph 80, short circuiting system 85 quickly (low time constant) transmits a high portion of the magnitude of the inlet step function disturbance 83 to the outlet. This system achieves better mixing than channeling system 84, because the paper pulp percentage at the outlet experiences less of a disturbance due to the step function input. However, the time constant here is lower than in channeling system 84, meaning that the input disturbance reaches the outlet faster, so it is harder for a water inlet feedback control system to improve the outlet paper pulp consistency.

Counterflow impeller system 86 is a system like that described in FIGS. 2A and 2B, where at least one counterflow impeller is used to create multiple active mixing zones. In graph 80, counterflow impeller system 86 slowly (high time constant) transmits a low portion of the magnitude of the inlet step function disturbance 83 to the outlet. This system achieves substantially better mixing than either channeling system 84 or short circuiting system 85, because the paper pulp percentage at the outlet experiences a relatively low disturbance due to the step function input. Also, the time constant here is higher than that in either channeling system 84 or short circuiting system 85, so it is easier for a water inlet feedback control system to improve the outlet paper pulp consistency. Therefore, graph 80 shows how counterflow impeller system 86 achieves superior mixing performance when compared with conventional paper pulp mixing systems.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Further, several advantages have been described that flow from the structure and methods; the present invention is not limited to structure and methods that encompass any or all of these advantages. Those skilled in the relevant art, having the benefit of the teachings of this specification, may effect numerous modifications to the invention as described herein, and changes may be made without departing from the scope and spirit of the invention as defined by the appended claims.

What is claimed:

1. A method of mixing of paper stock, having improved outlet consistency, comprising the steps of:

(a) feeding liquid and feeding paper pulp into a vessel to form a mixture;

(b) providing at least one counterflow impeller that is submerged in the mixture; the counterflow impeller being capable of simultaneously inducing both upward flow and downward flow;

(c) rotating the counterflow impeller such that downward flow from the impeller is partially recirculated by upward flow from the impeller to form a mixing zone;

(d) sensing a parameter of the mixture that is discharged from the vessel; and (e) controlling the feed rate of the liquid and the feed rate of the paper pulp in the feeding step (a) based on the sensing step (d).

2. The method of claim 1, wherein the at least one counterflow impeller of step (b) is two or three counterflow impellers that are mutually spaced apart, such that each impeller produces a substantially separate mixing zone upon rotating step (c).

3. The method of claim 1, wherein the parameter of sensing step (d) is percent paper pulp by weight or a proxy for percent paper pulp by weight.

4. The method of claim 1, wherein the paper stock mixture discharged from the vessel contains up to approximately 7% paper pulp by weight.

5. The method of claim 1, wherein the at least one counterflow impeller has a diameter that is between approximately 70% and approximately 90% of the vessel diameter.

6. The method of claim 1, wherein an uppermost one of the impellers is adapted to be adjacent to the mixture surface.

7. The method of claim 1, wherein the speed of the tip of each impeller does not exceed approximately 3 m/s.

8. The method of claim 1, wherein the vessel includes at least one water injection port.

9. The method of claim 1, wherein the vessel is a primary machine chest or an unrefined stock chest.

10. The method of claim 1, wherein the vessel includes:

a vertical orientation;

a top end; and a bottom end; and the paper pulp enters the vessel near the top end and exits near the bottom end.

11. The method of claim 10, wherein the at least one counterflow impeller has an axis of rotation that is substantially perpendicular to the vertical orientation of the vessel.

12. The method of claim 1 wherein the counterflow impeller has a first portion adapted for creating upward flow and a second portion adapted for creating downward flow.

13. The method of claim 12 wherein one of the first portion and the second portion is an inner portion of the impeller and the other one of the first portion and the second portion is an outer portion of the impeller.

14. An apparatus for mixing of paper stock, having improved outlet consistency, comprising:

a vessel for containing liquid and paper pulp;

at least one counterflow impeller, the counter flow impeller having a first portion adapted for creating upward flow and a second portion adapted for creating downward flow, said impeller:

adapted for submerging below the liquid and paper pulp surface; and adapted for simultaneously inducing both upward flow and downward flow; and a feedback system for controlling outlet consistency, comprising:

a sensor capable of determining a parameter of the mixture that is discharged from the vessel; and a controller capable of adjusting the feed rate of the liquid and the feed rate of the paper pulp that enters the vessel.

15. The apparatus of claim 14, wherein the at least one impeller is two or three counterflow impellers that are mutually spaced apart, such that each impeller is capable of producing a substantially separate mixing zone.

16. The apparatus of claim 14, wherein the parameter is percent paper pulp by weight or a proxy for percent paper pulp by weight.

17. The apparatus of claim 14, wherein the paper stock mixture discharged from the vessel contains up to approximately 7% paper pulp by weight.

18. The apparatus of claim 14, wherein the at least one counterflow impeller has a diameter that is between approximately 70% and approximately 90% of the vessel diameter.

19. The apparatus of claim 14, wherein an uppermost one of the impellers is adapted to be adjacent to the mixture surface.

20. The apparatus of claim 14, wherein the speed of the tip of each impeller does not exceed approximately 3 m/s.

21. The apparatus of claim 14, wherein the vessel includes at least one water injection port.

22. The apparatus of claim 14, wherein the vessel is a primary machine chest or an unrefined stock chest.

23. The apparatus of claim 14, wherein the vessel includes:

a vertical orientation;

a top end; and a bottom end; and the paper pulp enters the vessel near the top end and exits near the bottom end.

24. The apparatus of claim 23, wherein the at least one counterflow impeller has an axis of rotation that is substantially perpendicular to the vertical orientation of the vessel.

25. The apparatus of claim 14 wherein one of the first portion and the second portion is an inner portion of the impeller and the other one of the first portion and the second portion is an outer portion of the impeller.

* * * * *